United States Patent [19]

Heiting

[11] 4,030,390

[45] June 21, 1977

[54] APPARATUS FOR CUTTING ITEMS FROM A SHEET

[75] Inventor: Richard H. Heiting, Little Chute, Wis.

[73] Assignee: Fox Valley Tool & Die, Inc., Kaukauna, Wis.

[22] Filed: Sept. 10, 1975

[21] Appl. No.: 612,021

[52] U.S. Cl. ..... 83/123; 83/143; 83/205; 83/266; 83/563

[51] Int. Cl.[2] ..... B26D 7/06; B26D 5/20; B26D 5/08

[58] Field of Search ..... 83/563, 437, 266, 562, 83/558, 524, 203, 205, 467, 590, 141, 123, 588; 269/319

[56] References Cited

UNITED STATES PATENTS

| | | | |
|---|---|---|---|
| 19,384 | 2/1858 | Simpson | 83/141 |
| 1,827,709 | 10/1931 | Leavenworth | 83/563 X |
| 2,144,059 | 1/1939 | Herschel et al. | 83/563 X |
| 2,748,862 | 6/1956 | Alspaugh | 83/524 X |
| 3,211,038 | 10/1965 | Lake et al. | 83/467 |
| 3,677,121 | 7/1972 | Etchell | 83/437 |
| 3,759,122 | 9/1973 | Lane et al. | 83/925 R |
| 3,832,083 | 8/1974 | Dockery | 83/266 X |
| 3,848,495 | 11/1974 | Youra | 83/467 X |

FOREIGN PATENTS OR APPLICATIONS

| | | | |
|---|---|---|---|
| 13,005 | 10/1886 | United Kingdom | 83/141 |

*Primary Examiner*—Travis S. McGehee
*Attorney, Agent, or Firm*—Andrus, Sceales, Starke & Sawall

[57] ABSTRACT

An apparatus for cutting items, such as individual photographs, from a printed sheet comprising a sliding tray having a lower die to support the sheet and adapted to be moved into a housing containing an upper die. The lower die includes a series of male die members corresponding in shape to the individual photographs and the marginal area bordering the die members is spring loaded and biased to an upper position. The upper die has a series of recesses or female die members corresponding in shape to the male die members of the lower die. As the upper die is moved downwardly, the individual photographs are severed from the sheet by the shearing action of the cooperating die members.

4 Claims, 2 Drawing Figures

Fig. 1
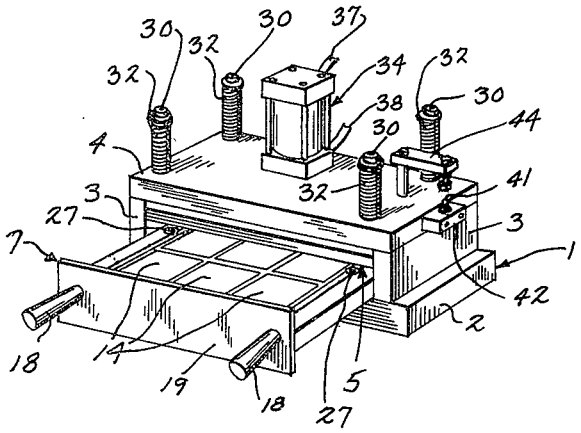
Fig. 4
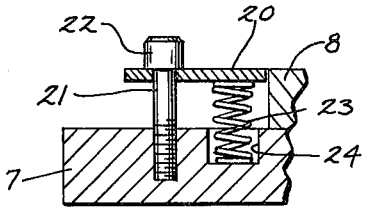
Fig. 5
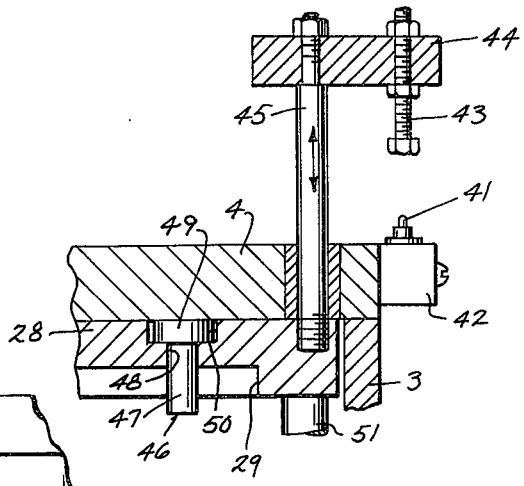
Fig. 6
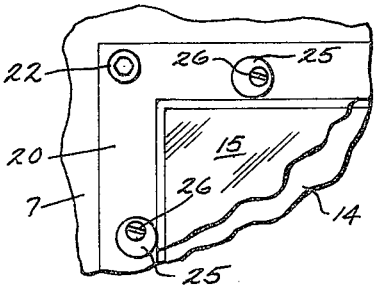
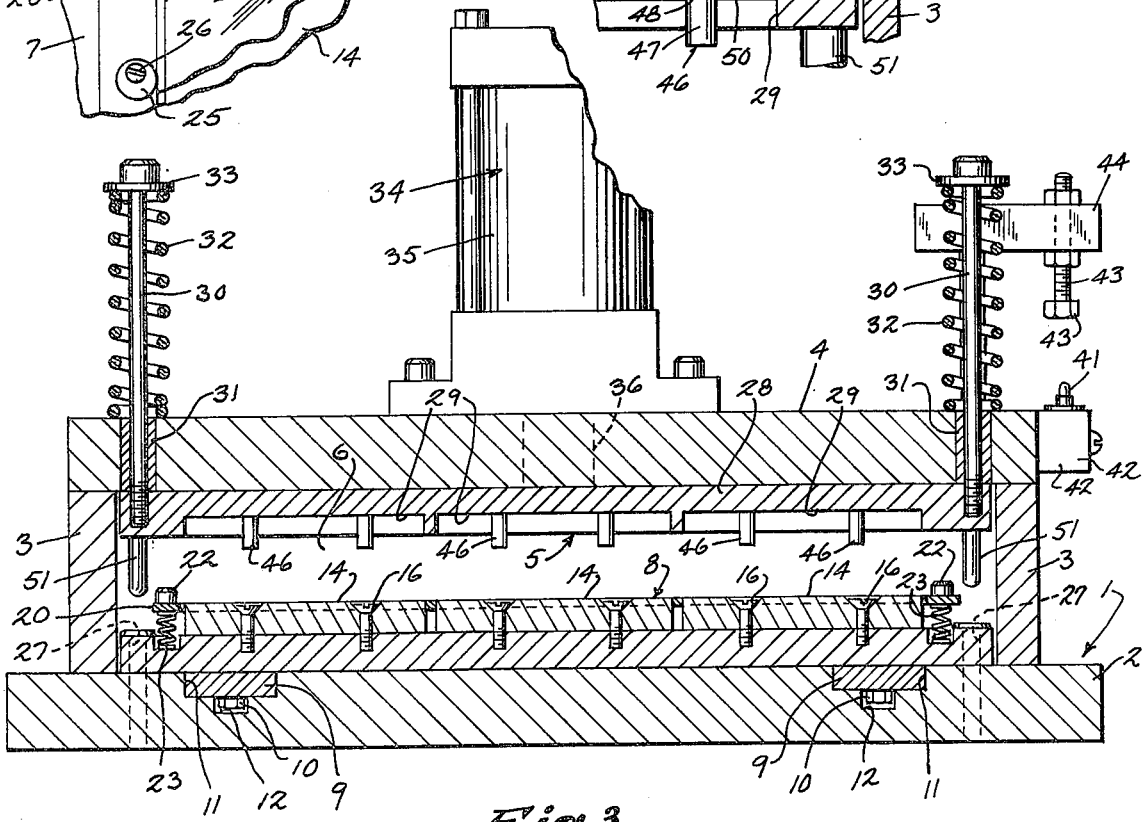
Fig. 3

APPARATUS FOR CUTTING ITEMS FROM A SHEET

BACKGROUND OF THE INVENTION

Frequently a series of photographs are printed on a sheet and the individual photographs are thereafter cut from the sheet. In the past a steel rule type of die has been used to cut the individual photographs in which the sheet is placed on a flat lower die and the upper steel rule die is moved down against the lower die bed to cut the sheet. Frequently, the steel rule die does not cleanly cut the edges of the individual photographs, resulting in some tearing of the paper which is particularly noticeable when dealing with borderless color prints.

SUMMARY OF THE INVENTION

The invention relates to an improved apparatus for cutting individual photographs from a sheet. The apparatus includes a sliding tray having a lower die to support the sheet and adapted to be moved into a housing containing a movable upper die.

The lower die includes a series of anvils or male die members which are generally rectangular and correspond in shape to the individual photographs on the sheet. The marginal area of the lower die bordering the die members is spring loaded and biased to an upper position where the upper surface of the marginal area is generally flush with the upper surfaces of the die members.

The upper die has a series of generally rectangular female die members which are shaped to cooperate with the male die members of the lower die to sever the sheet. As the upper die is moved downwardly, the upper die engages the spring loaded marginal area of the lower die forcing the marginal area downwardly, and the female die members register with the male die members of the lower die to cut the individual photographs by a shearing type of action.

The apparatus also includes a series of cam-shaped alignment pins which are engaged by the edges of the sheet to properly align the sheet with respect to the lower die. The cams can be rotated to adjust the alignment and locked in the desired position.

The apparatus also includes an automatic sequencing arrangement in which the tray, as it is moved into the housing, actuates a limit switch to operate a hydraulic cylinder to thereby lower the upper die. When the upper die reaches a predetermined lower position, a second limit switch is actuated to thereby reverse the flow of hydraulic fluid into the cylinder and raise the upper die.

A knock-out mechanism is also associated with the upper die which acts to automatically release the individual prints from the upper die as the upper die moves to its upper position. In addition, the spring-loaded marginal area of the lower die, acts to eject the marginal scrap from the lower die.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the apparatus of the invention with the tray shown in the partially extended position;

FIG. 3 is a section taken along line 3—3 of FIG. 2;

FIG. 4 is a section taken along line 4—4 of FIG. 2;

FIG. 5 is a section taken along line 5—5 of FIG. 2; and

FIG. 6 is a fragmentary enlarged plan view of the tray showing the cam aligning members.

DESCRIPTION OF THE PREFERRED EMBODIMENT

Figure 2:
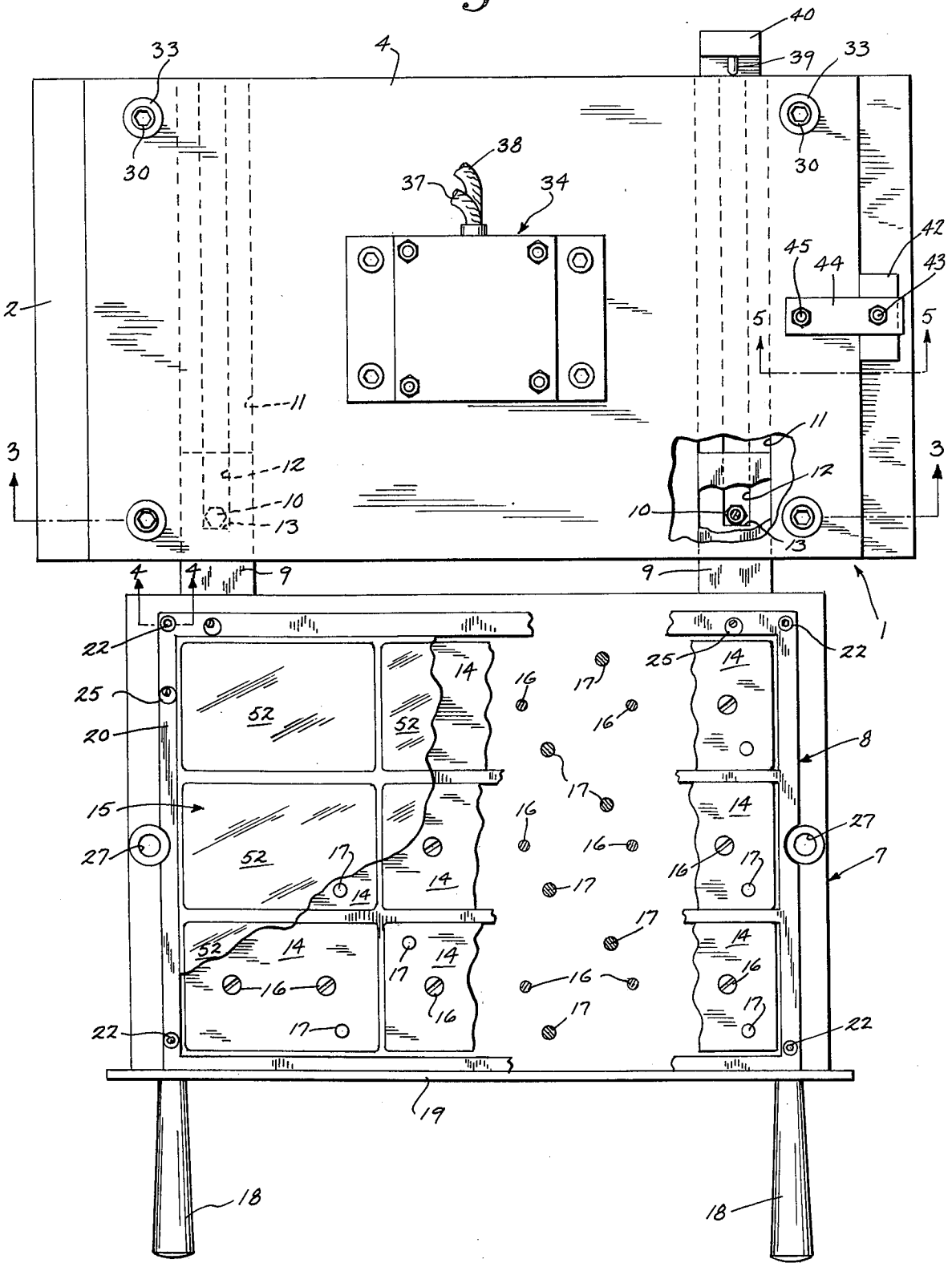
FIG. 2 is a plan view of the apparatus with parts broken away and showing the tray in the extended position.

The drawings illustrate an apparatus for cutting a series of individual photographs from a printed sheet. The apparatus includes a supporting structure or frame 1 including a base plate 2, side walls 3, and a top plate 4 which is connected to the upper edges of the side walls 3. An upper die 5 is mounted on the lower surface of the top plate and the space between the upper die 5 and the base plate 2 defines a chamber or cavity 6.

A tray 7 is mounted for sliding movement with respect to the supporting structure 1, and the tray carries a lower die 8. The tray 7 is movable from an outer or extended position, in which the lower die 8 is located out of the chamber 6, to an inner position in which the lower die is located within the chamber 6 beneath the upper die 5.

To mount the lower die for sliding movement with respect to the supporting structure 1, a pair of guide bars 9 are mounted on the lower surface of the tray by bolts 10, and the guide bars 9 are adapted to slide within guideways 11 formed in the upper surface of the base 2. The bolts 10 are adapted to slide within grooves 12 formed in the base and engagement of the bolts 10 with the ends 13 of the respective grooves prevents the tray from sliding completely out of the supporting structure.

As shown in FIG. 2, the lower die 8 includes a plurality of male die members or anvils 14 which are generally rectangular in shape and conform in size to the individual photographs on the printed sheet 15 which is to be supported on the lower die. While the drawings show the sheet 15 having nine individual photographs, the sheet can contain any desired number of photographs. The die members 14 are connected to the tray 7 by screws 16, and dowels 17, which are disposed in aligned opening in the die members and the tray, serve to properly align the die members with respect to the tray.

To move the tray in and out with respect to the supporting structure, a pair of handles 18 are connected to the outer edge of the tray, and end plate 19 is connected to the outer edge of the tray and serves as a stop to limit inward movement of the tray.

As shown in FIG. 2, a plate 20 borders the individual die members 14 and the plate 20 is connected to the tray by a series of bolts 21 which extend freely through the plate and are threaded into the tray. As shown in FIG. 4, the head 22 of each bolt 21 bears against the outer surface of the plate and limits upward movement of the plate 21 with respect to the tray.

The plate 20 is spring loaded to a position where the upper surface of the plate is substantially flush with the upper surface of the die members 14 by a series of springs 23. The lower ends of the springs are located within holes 24 formed in the tray, while the upper ends of the springs bear against the lower surfaces of the plate 20. The force of the springs 23 will urge the plate into bearing engagement with the heads 22 of bolts 21.

To provide an adjustment for the position of the sheet 15 with respect to the lower die 8, a plurality of cams 25 are mounted on the plate 20. Each cam 25 is connected to the plate 20 through a screw 26 and by tightening down the screws, the cam 25 can be locked in position.

Two of the cams 25 are positioned to be engaged by the inner end of the sheet 15 as it is positioned on the lower die, while the third cam is adapted to be engaged by a side edge of the sheet. By rotation of the cams, the position of the sheet can be adjusted with respect to the lower die members 14.

The lower die 8 is also provided with a pair of alignment holes 27, which are located along the side edges of the tray.

As shown in FIG. 3, the upper die 5 includes a die plate 28 having a plurality of female die members 29 defined by generally rectangular recesses which correspond in number and shape to the male die members 14 or the lower die, so that the die members 14 and 29 will mate on lowering of the upper die 5.

The upper die plate 28 is connected to the top plate 4 by a series of studs 30 which are mounted for sliding movement within bushings 31 mounted in holes in the top plate 4. The lower end of each stud 30 is threaded into a hole in the die plate 28. To bias the upper die plate 28 to an upper position where it is in engagement with the lower surface of the top plate 4, springs 32 are associated with the studs 30. The lower end of each spring bears against the plate 4 while the upper end of the spring bears against a washer 34 so that the springs urge the plate 28 upwardly.

The upper die 5 is adapted to be moved downwardly toward the lower die by a cylinder unit 34 which includes a hydraulic cylinder 35 mounted on the upper surface of top plate 4. A ram 36 is mounted for sliding movement within the cylinder 35 and the lower end of the ram is connected to the plate 28. Hydraulic fluid is introduced into the cylinder 35 through lines 37 and 38.

When the tray 7 supporting sheet 15 is moved inwardly of the supporting structure 1, the inner end of the tray is adapted to engage a limit switch 39 mounted on bracket 40 which thereby operates through a valve mechanism to supply hydraulic fluid through line 37 to extend the ram and lower the upper die 5. When the upper die has moved downwardly to a predetermined position, a second limit switch 41 is adapted to be engaged to operate the valving to cut off the flow of fluid through line 37 and supply fluid through line 38 to thereby retract the ram 36 and move the upper die upwardly. The limit switch 41 is carried by a bracket 42 mounted on the side wall 3 and the limit switch 41 is adapted to be engaged by the lower end of an adjustable stud 43 carried by arm 44 that is attached to the upper end of a rod 45. The lower end of the rod extends through an opening in the top plate 4 and is threaded into the plate 28. Thus, as the plate 28 is lowered, the stud 43 will engage the limit switch 41 to reverse the movement of the cylinder unit 34.

The invention also includes a series of knock-out pins 46 which are employed to release the individual prints from the female die members 29 in the upper die. As shown in FIG. 5, each knock-out pin 46 includes a shank 47 which is mounted for sliding movement in the bore 48 in die plate 28, and each pin also includes an enlarged head 49 which is positioned within a recess 50 in the die plate. The pins 46 are freely slidable within the bores 48 and as the die plate 28 is lowered toward the lower die 8, the pins 46 will engage the die members 14 and move upwardly with respect to the die plate. After the photographs have been cut from the sheet the photograhs may be lodged or jammed within the die members 29 of the upper die and as the upper die is moved upwardly, the heads 49 of the pins 46 will engage the undersurface of top plate 4 forcing the pins downwardly, to the position shown in FIG. 5, to thereby release or eject the cut photographs which may be lodged within the die members or recesses 29.

In operation of the apparatus, the sheet 15 containing a series of individual photographs is positioned on the tray 7 and the individual photographs are aligned on the male die members 14 through the cam alignment members 25. The tray is then pushed inwardly of the supporting structure and when the lower die has moved into position beneath the upper die, the limit switch 39 is actuated to supply hydraulic fluid to the cylinder unit 34 to lower the upper die 5. As the upper die moves downwardly, aligning pins 51 carried by the upper die are received within the alignment holes 27 in the lower die to provide proper registry between the die members.

The individual photographs 52 are cut from the sheet by the shearing action of the mating or cooperating male and female die members 14 and 29. As the female die members 29 register with the male die members 14, the die members 29 will depress the spring loaded plate 20. As the lower die has a shallow V-shape in a direction from front to rear, the cutting will be progressive from the center of the sheet outwardly toward the front and rear edges.

After the individual photographs have been severed the limit switch 41 will be contacted by stud 43 thereby reversing the flow of fluid to the hydraulic cylinder 35 and moving the upper die to the upper position. As the upper die 5 is raised, the heads 49 of the knock-out pins 46 will engage the undersurface of top plate 4, thereby moving the pins downwardly and ejecting the individual photographs 52 from the female die members 29. At the same time, the springs 23 will urge the plate 20 upwardly, thereby releasing the marginal scrap of the sheet from the male die members 14.

The apparatus of the invention provides an improved device for cutting individual photographs from a sheet in which the photographs are severed by a shear type of action, thereby providing a cleaner cut without tearing of the paper which is particularly important when cutting borderless color prints.

The apparatus includes an automatic sequencing mechanism whereby the upper die will be lowered and raised automatically to accomplish the cutting action.

While the drawings illustrate the apparatus as being used to cut a series of photographs from a sheet, it is contemplated that it can also be used to cut various other types of cards or individual articles from a larger sheet.

I claim:

1. An apparatus for cutting a plurality of photographs from a sheet, comprising a housing defining an opening, a tray slidably mounted with respect to the housing from an extended position in which the tray is located outside of the housing to an inner position where the tray is located within the housing, a first die carried by the tray, a second die carried by the housing, one of said dies having a plurality of male die members corresponding in shape to the photographs to be cut from the sheet and the other of said dies having a plurality of female die members disposed to cooperate with said male die members to cut said photographs from the sheet located between said die members, a plate bordering said male die members, and means for biasing the plate outwardly away from the corresponding die to a position where the outer surface of said plate is generally flush with the outer surfaces of said male die members, operating means for moving one of said dies relative to the other of said dies to thereby cut said photographs from the sheet, and adjustable aligning means disposed on the tray for aligning the sheet with the die members associated with the tray, said aligning means comprising a plurality of rotatable cam means on said tray and disposed to be engaged by at least two edges of the sheet to align said sheet with respect to the corresponding die members, and locking means for locking the cam means in a given position

2. An apparatus for cutting a plurality of photographs from a sheet, comprising a housing defining an opening, a tray slidably mounted with respect to the housing from an extended position in which the tray is located outside of the housing to an inner position where the tray is located within the housing, a first die carried by the tray, a second die carried by the housing, one of said dies having a plurality of male die members corresponding in shape to the photographs to be cut from the sheet and the other of said dies having a plurality of female die members disposed to cooperate with said male die members to cut said photographs from the sheet located between said die members, a plate bordering said male die members, and means for biasing the plate outwardly away from the corresponding die to a position where the outer surface of said plate is generally flush with the outer surfaces of said male die members, operating means for moving one of said dies relative to the other of said dies to thereby cut said photographs from the sheet, and adjustable aligning means disposed on the tray for aligning the sheet with the die members associated with the tray, said aligning means comprising a plurality of rotatable cam means on said tray and disposed to be engaged by at least two edges of the sheet to align said sheet with respect to the corresponding die members, locking means for locking the cam means in a given position, ejecting means associated with each of said of said female die members for ejecting the cut photographs from said female die members, said ejecting means comprising a plurality of pins, and means responsive to the movable die moving away from the other of said dies after the photographs have been cut to move said pins relative to said female die members to eject said photographs.

3. An apparatus for cutting a plurality of printed items from a sheet, comprising a housing defining an opening, a tray slidably mounted for movement within the opening from the extended position in which the tray is located outside of the housing to an inner position where the tray is located within the housing, said housing including an upper support and having a lower die spaced beneath the upper support, said lower die including a plurality of male die members, an upper die located between the upper support and the lower die and mounted for movement relative to the upper support, said upper die having a plurality of female die members disposed to cooperate with said male die members to cut said items from the sheet located between said die members as the upper die is moved toward the lower die, means for moving the upper die toward the lower die, first biasing means for biasing the upper die upwardly toward said upper support, a plate mounted on the housing and having a series of openings, said male die members being received within said openings, and second biasing means for biasing the plate upwardly to a position where the outer surface of the plate is generally flush with the outer surfaces of the male die members, said upper die having a surface bordering said female die members disposed to engage the plate to depress the plate against the force of the second biasing means as the upper die is moved toward the lower die.

4. The apparatus of claim 3, and including ejecting means associated with each of said female die members for ejecting the cut items from said female die members, said ejecting means comprising an ejecting member slidably mounted within an opening in each female die member, upward movement of said upper die after the items have been cut acting to move said ejecting members into contact with said upper support to thereby lower said ejecting members relative to said upper die and eject said items from the female die members.

* * * * *

UNITED STATES PATENT AND TRADEMARK OFFICE

CERTIFICATE OF CORRECTION

PATENT NO. : 4,030,390

DATED : June 21, 1977.

INVENTOR(S) : RICHARD H. HEITING

It is certified that error appears in the above-identified patent and that said Letters Patent are hereby corrected as shown below:

Column 4, Line 63, Before "I claim:" insert the following paragraph ---Various modes of carrying out the invention are contemplated as being within the scope of the following claims particularly pointing out and distinctly claiming the subject matter which is regarded as the invention.---, Column 5, Line 22, CLAIM 1, After "position" insert ---.--- (a period), Column 6, Line 2, CLAIM 2, Cancel "of said", second occurrence.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*